US006786021B1

(12) United States Patent
Chen

(10) Patent No.: US 6,786,021 B1
(45) Date of Patent: Sep. 7, 2004

(54) DOOR PANEL ASSEMBLY HAVING FLEXIBLE HINGE MEMBERS

(76) Inventor: Chang Than Chen, 12F, No. 426, Ming Chuan 2nd Road, Chien Chen Chu, Kaohsiung (TW), 801

( * ) Notice: Subject to any disclaimer, the term of this patent is extended or adjusted under 35 U.S.C. 154(b) by 0 days.

(21) Appl. No.: 10/420,408

(22) Filed: Apr. 22, 2003

(51) Int. Cl.[7] ..... E04C 2/54
(52) U.S. Cl. ..... 52/784.1; 49/501; 160/236
(58) Field of Search ..... 52/784.1, 473, 52/36.5; 160/236, 199; 49/501, 502

(56) References Cited

U.S. PATENT DOCUMENTS 1,694,522 A * 12/1928 Victor ..... 52/784.1
2,667,951 A * 2/1954 Gall ..... 52/204.595
2,978,020 A * 4/1961 Paulsrude ..... 160/183
4,251,966 A * 2/1981 Foltman ..... 52/309.1
5,634,998 A 6/1997 Schiedegger et al. ..... 156/73.1
5,782,282 A 7/1998 Chen ..... 160/206
5,924,255 A * 7/1999 Vagedes ..... 52/473
6,151,849 A * 11/2000 Twigg et al. ..... 52/208
6,330,902 B1 12/2001 Chen ..... 160/231.2
2003/0047293 A1 * 3/2003 Lee ..... 160/236

* cited by examiner

*Primary Examiner*—Korie Chan
(74) *Attorney, Agent, or Firm*—Charles E. Baxley

(57) ABSTRACT

A door panel device includes a door panel having two posts, and one or more plates secured between the inner side portions of the posts with catches. Two further door panels each includes a post coupled to the respective posts of the door panel with a flexible hinge member. The flexible hinge member may be solidly secured between the posts of the door panels with such as mold injection processes, to prevent the flexible hinge member from being moved relative to the posts of the door panels. One or more boards may further be secured between the posts with catches and secured to the plate with couplers.

2 Claims, 7 Drawing Sheets

DOOR PANEL ASSEMBLY HAVING FLEXIBLE HINGE MEMBERS

BACKGROUND OF THE INVENTION

1. Field of the Invention

The present invention relates to a door panel assembly, and more particularly to a door panel assembly having flexible hinge members for flexibly coupling door panels together.

2. Description of the Prior Art

Typical door panel assemblies may comprise a number of parts or elements that may be assembled together, and that may be coupled to the other door panels. For example, U.S. Pat. No. 5,634,998 to Schiedegger et al. discloses one of the typical door panel assemblies having a number of parts or elements to be assembled together. However, the door panels include a solid structure that may not be foldably or flexibly coupled to the other door panel devices.

The applicant has developed another typical door panel assembly which has been issued as U.S. Pat. No. 5,782,282 to Chen, and which includes two or more door panels that may be foldably coupled together, for allowing two or more door panel assemblies to be foldably or pivotally coupled together. However, the door panels may be folded relative to each other, but may not be flexibly coupled together.

The applicant has further developed the other typical door panel assembly which has been issued as U.S. Pat. No. 6,330,902 B1 to Chen, and which includes two or more door panels that may be flexibly coupled together with flexible links, for allowing two or more door panel assemblies to be flexibly coupled together. However, the flexible links of the door panels are slidably engaged in the door panels and may not be solidly secured to the door panels.

The present invention has arisen to mitigate and/or obviate the afore-described disadvantages of the conventional door panel assemblies.

SUMMARY OF THE INVENTION

The primary objective of the present invention is to provide a door panel assembly having flexible hinge members for flexibly coupling door panels together, in which the flexible hinge members are solidly secured to the door panels.

In accordance with one aspect of the invention, there is provided a door panel assembly comprising a first door panel including a first post and a second post each having an inner side portion, at least one plate secured between the inner side portions of the posts of the first door panel, a second door panel including a post, a first flexible hinge member secured between the post of the second door panel and the first post of the first door panel with mold injection processes, to prevent the first flexible hinge member from being moved relative to the post of the second door panel and the first post of the first door panel, a third door panel including a post, and a second flexible hinge member secured between the post of the third door panel and the second post of the first door panel with mold injection processes, to prevent the second flexible hinge member from being moved relative to the post of the third door panel and the second post of the first door panel.

The posts of the first door panel each includes a channel formed in the inner side portion thereof, the plate includes two sides each having a catch provided thereon and slidably engaged in the channels of the posts, to secure the plate between the posts of the first door panel.

One or more boards each may include two sides each having a catch provided thereon and slidably engaged in the channels of the posts, to secure the board between the posts of the first door panel. One or more couplers may further be provided and coupled between the board and the plate.

The plate includes a recess formed therein, the coupler is received in the recess of the plate and includes a groove formed therein, the board includes an edge engaged into the groove of the plate. The coupler includes a pair of latches engaged with the plate to prevent the coupler from engaging into the plate, the groove of the coupler is formed between the latches.

The posts of the first door panel each includes a pair of flanges extended inward of the channel thereof respectively and engaged with the catches and to secure the plate to the posts of the first door panel. The flanges of the posts of the first door panel each includes an outer portion having a bar engaged therein, and/or having an inclined surface formed therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
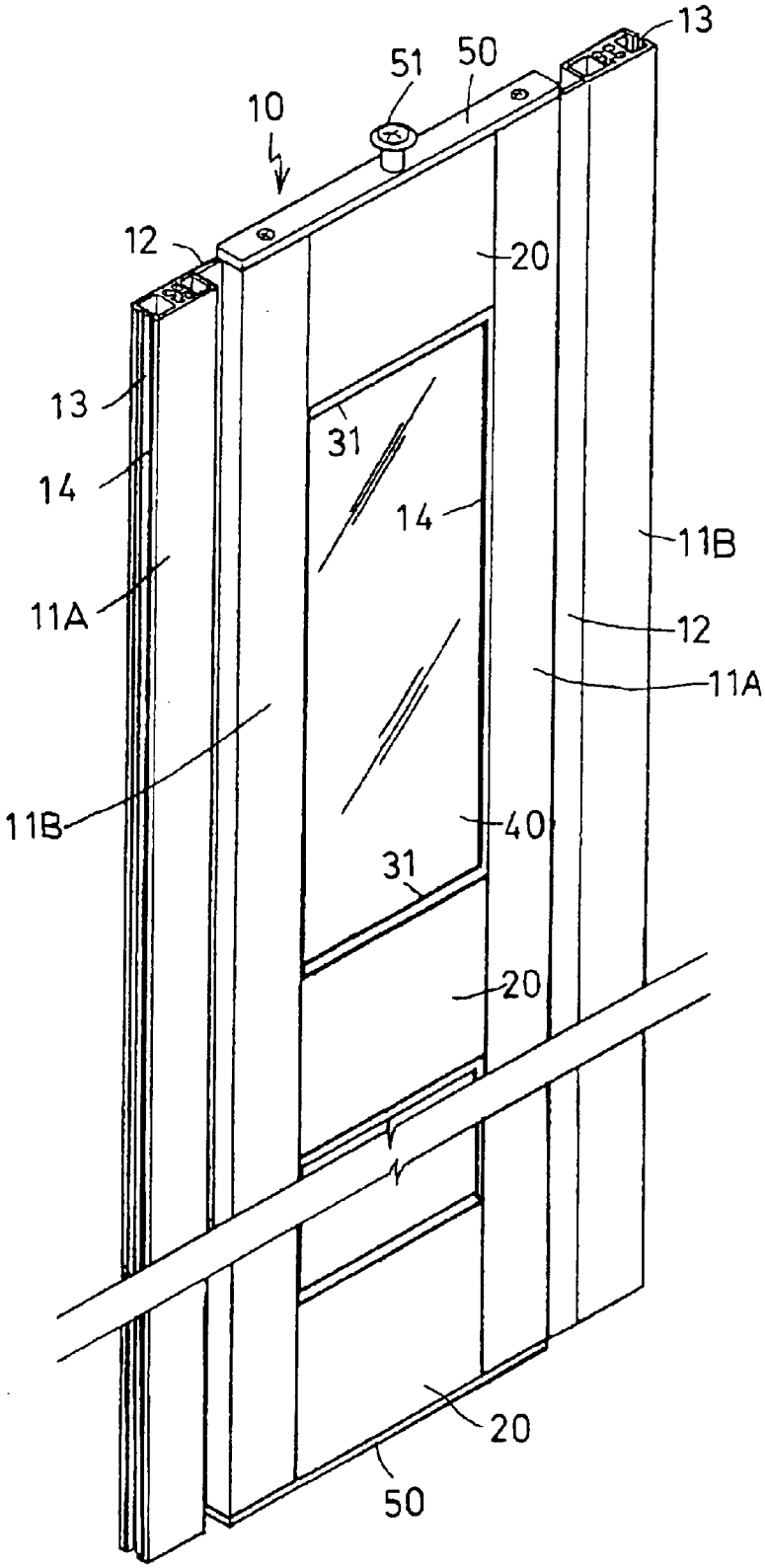
FIG. 1 is a perspective view of a door panel assembly in accordance with the present invention.

Referring to the drawings, and initially to FIGS. 1–8, a door panel assembly in accordance with the present invention is primarily provided for attaching to sliding door facilities (not shown), and comprises a number of door panels 10 to be pivotally or flexibly coupled together. Each of the door panels 10 includes a pair of posts 11A, 11B spaced away from each other and parallel to each other.

As shown in FIGS. 1–3, 5 and 7, a first or a complete door panel 10 is shown in the middle portion of the respective drawings, a post 11A of another door panel 10 is pivotally or flexibly coupled to the post 11B of the first door panel 10 with a flexible hinge member 12, and a post 11B of a further door panel 10 is pivotally or flexibly coupled to the post 11A of the first door panel 10 with another flexible hinge member 12, such that the door panels 10 may be flexibly coupled together with the flexible hinge members 12.

The posts 11A, 11B of each of the door panels 10 include an upper portion and a lower portion each of which is secured together with a rod 50, in order to form a solid or integral door panel. Each of the upper rods 50 includes a wheel or roller 51 attached thereon for slidably or rotatably engaged with track members (not shown) of the sliding door facilities (not shown).

Instead of the rod 50, the other coupling devices (not shown) may also be provided for securing the posts 11A, 11B together. For example, the door panel 10 may include an integral beam (not shown) formed in the bottom portion or the upper portion or the middle portion thereof and provided between the posts 11A, 11B for securing the posts 11A, 11B together.

Each of the posts 11A, 11B of each of the door panels 10 includes a channel 13 formed in the inner portion thereof, and includes a pair of opposite flanges 110 extended inward of each of the channels 13 (FIGS. 6, 8) thereof. The flanges 110 each includes a bar 14 engaged therein, particularly engaged in the outer portion thereof, and preferably having a color different from that of the posts 11A, 11B and/or the door panel 10.

Figure 6:
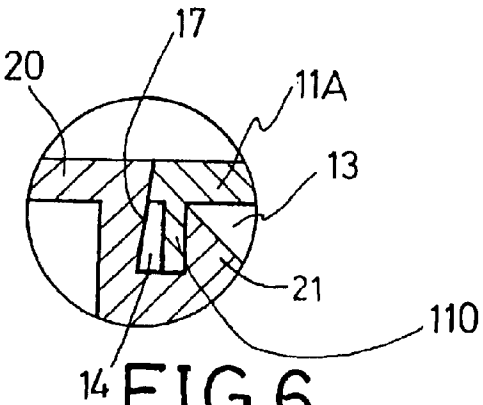
FIG. 6 is an enlarged partial cross sectional view of the door panel assembly as shown in FIG. 5.
Figure 8:
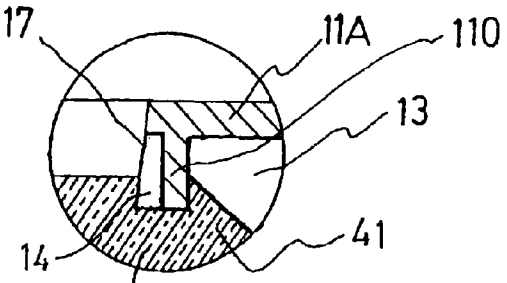
FIG. 8 is an enlarged partial cross sectional view of the door panel assembly as shown in FIG. 7.

As best shown in FIGS. 6 and 8, it is preferable that the bars 14 each includes an inclined outer surface 17 formed thereon, to allow the bars 14, particularly the colors of the bars 14 to be seen from either the front or the rear portion of the door panel 10.

The posts 11A, 11B, and the flexible hinge member 12, and the bars 14 may be formed with different materials and/or different colors and may be simultaneously formed or manufactured by such as a mold injection machine. For example, the mold injection machine may include three ports to receive three different materials having different colors, in order to mold injecting and forming the door panels 10.

Accordingly, the flexible hinge member 12 may be solidly secured between the posts 11A, 11B of two different door panels 10 by mold injection processes, and will not be moved relative to the posts 11A, 11B of the door panels 10, and are thus not required to be assembled onto the posts 11A, 11B of the door panels 10.

One or more plates 20 each may include two sides each of which includes a catch 21 extended therefrom and slidably engaged in the respective channels 13 of the posts 11A, 11B, and engaged with the flanges 110, to secure the plates 20 between the posts 11A, 11B of the door panel 10.

Figure 4:
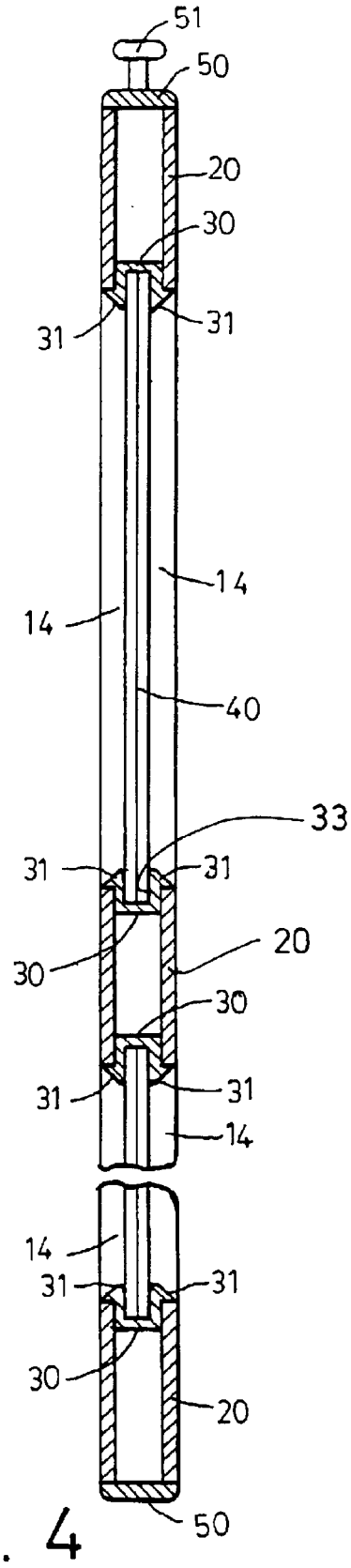
FIG. 4 is a cross sectional view taken along lines 4—4 of FIG. 3.

The plates 20 each includes an upper portion and/or a lower portion having a recess 23 formed therein (FIG. 2) to receive a coupler 30 therein. The couplers 30 each may include a pair of latches 31 provided thereon or extended therefrom, to engage with the plate 20, and to prevent the couplers 30 from being completely engaged into the plates 20 (FIG. 4). The couplers 30 each may further include a groove formed therein, such as formed between the latches 31.

One or more boards 40, such as transparent boards 40, may further be provided and each may include two sides each of which includes a catch 41 extended therefrom and slidably engaged in the respective channels 13 of the posts 11A, 11B, and engaged with the flanges 110, to secure the boards 40 between the posts 11A, 11B of the door panel 10.

The boards 40 each may include an upper edge and/or a lower edge received in the grooves 33 of the couplers 30, such that the plates 20 and the boards 40 may be solidly secured between the posts 11A, 11B of the door panel 10.

Figure 2:
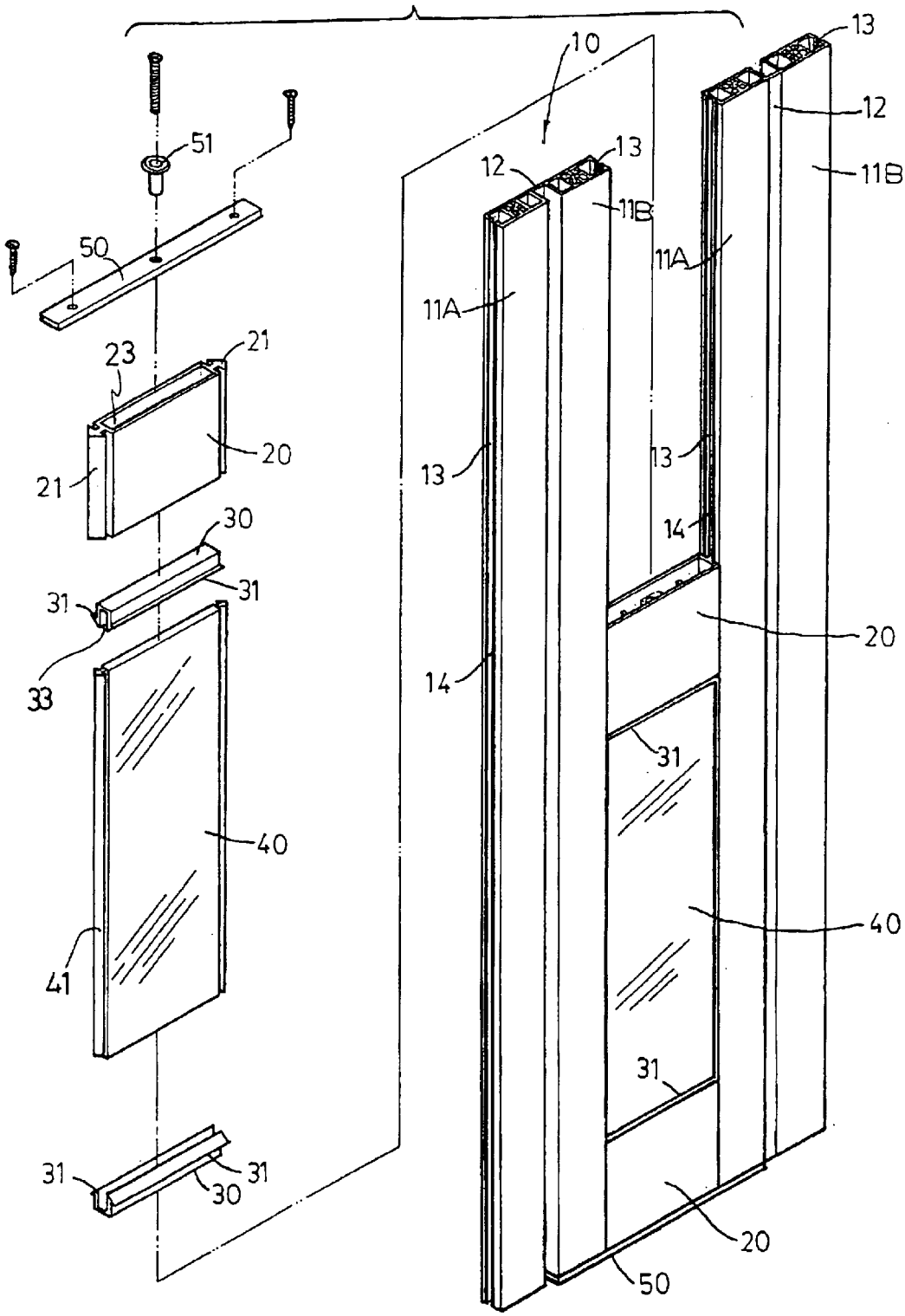
FIG. 2 is an exploded view of the door panel assembly.
Figure 3:
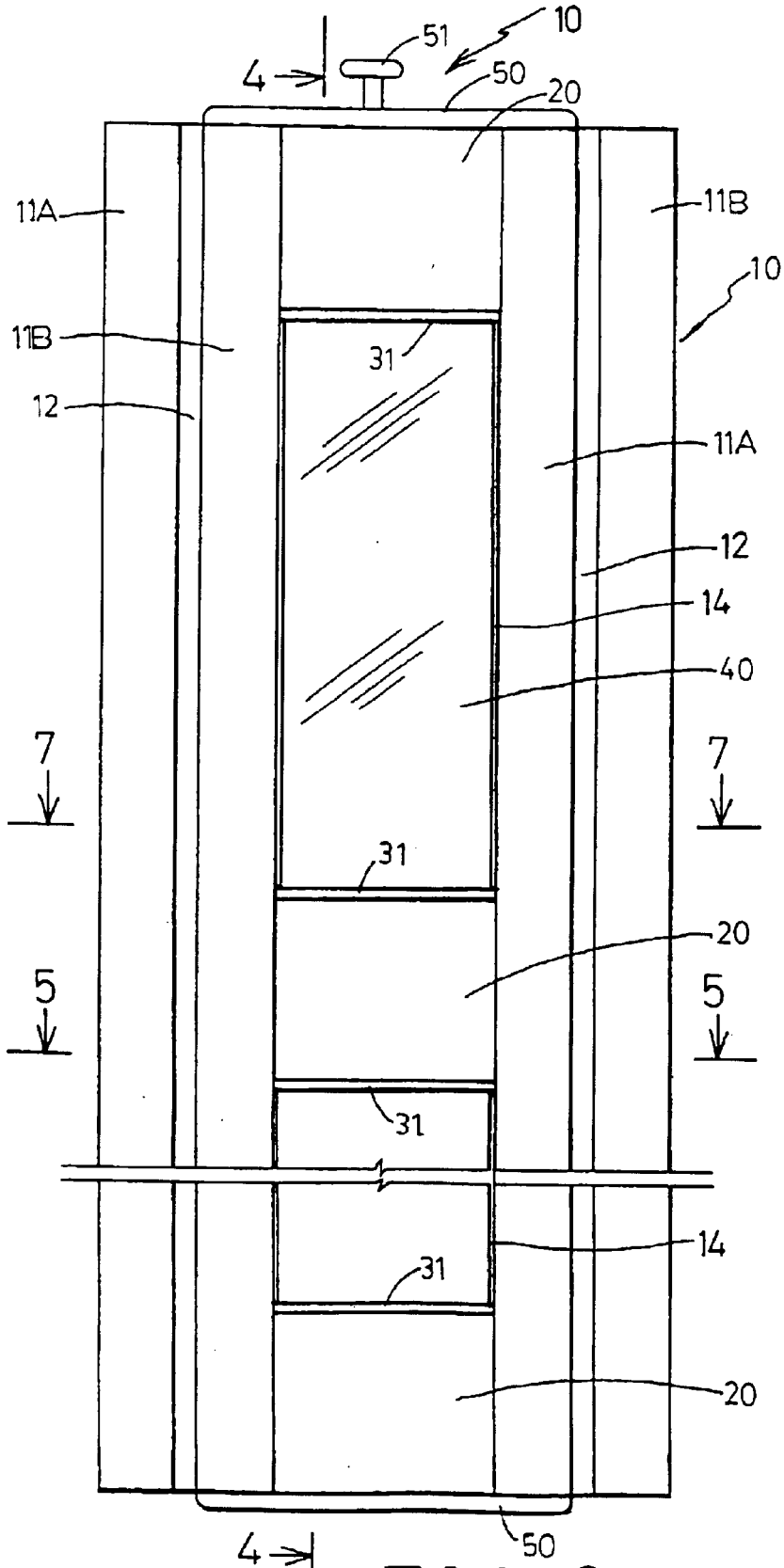
FIG. 3 is a front view of the door panel assembly.
Figure 5:
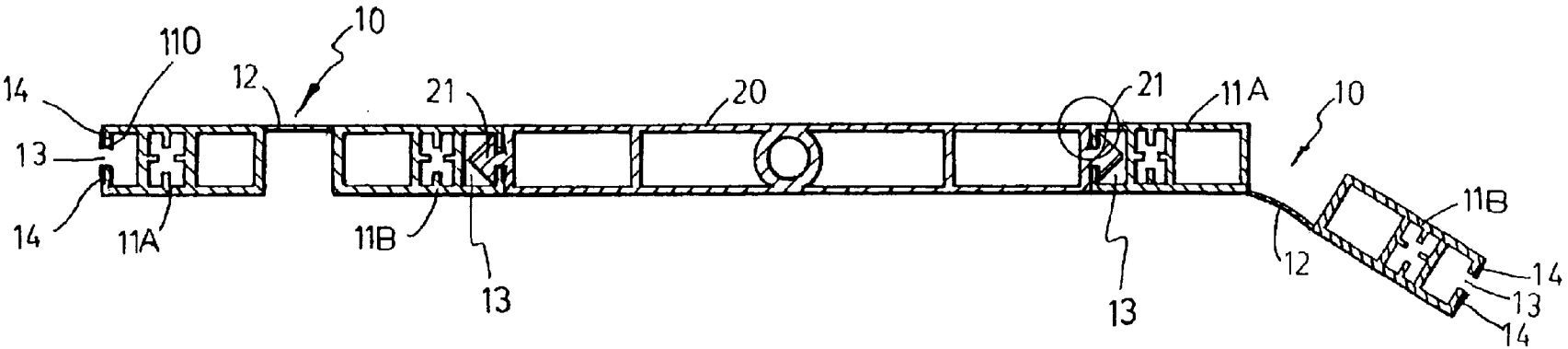
FIG. 5 is a cross sectional view taken along lines 5—5 of FIG. 3.
Figure 7:
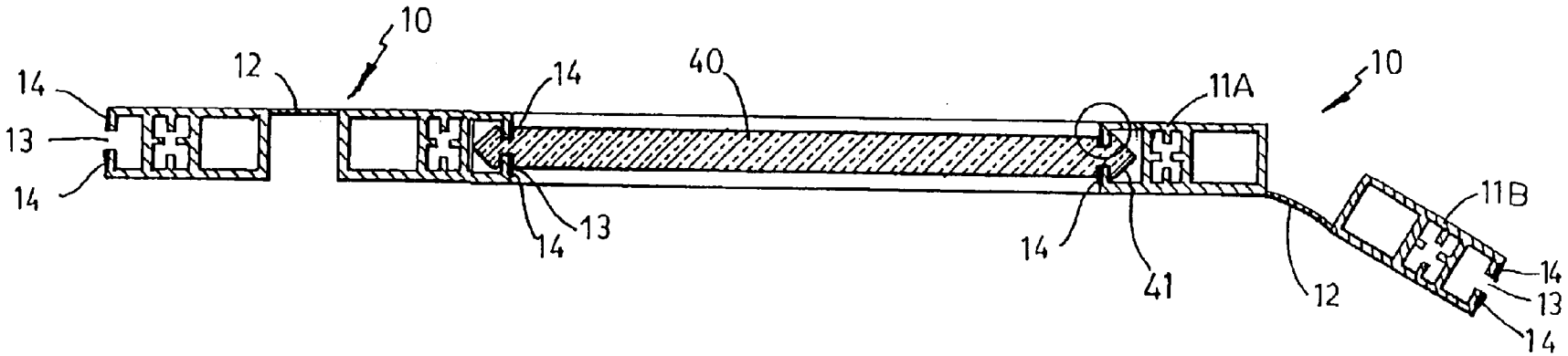
FIG. 7 is a cross sectional view taken along lines 7—7 of FIG. 3.
Figure 9:
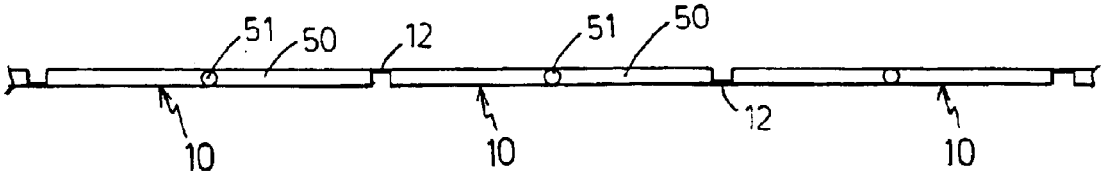
FIGS. 9 and 10 are top schematic views illustrating the operation of the door panel assembly.
Figure 10:
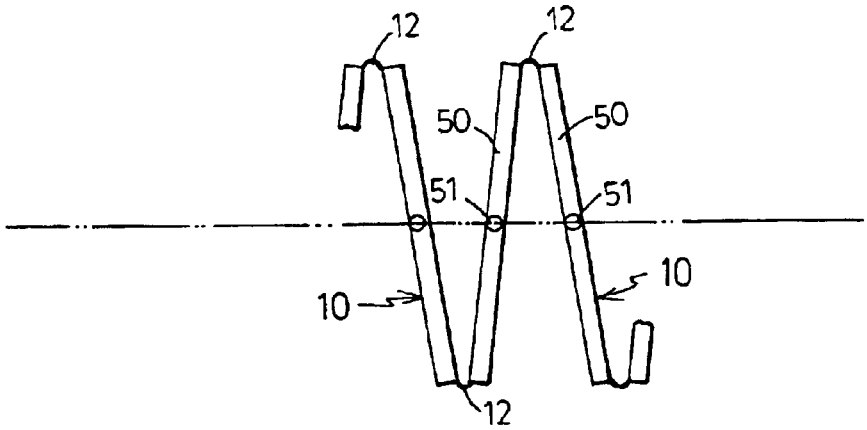

It is to be noted that, as best shown in FIG. 5, the plates 20 include a thickness identical to that of the posts 11A, 11B of the door panel 10, such that the colored bars 14 may be shielded by the plates 20 (FIGS. 1, 2). As best shown in FIG. 7, the boards 40 include a thickness less than that of the posts 11A, 11B of the door panel 10, such that a portion of the bar 40 may be exposed (FIG. 8).

In addition, the boards 40 may be made of transparent or semi-transparent materials, such that the portions of the bars 14 shielded or covered by the transparent or semi-transparent boards 40 may also be seen by people.

It is further to be noted that the flexible hinge member 12 may be solidly secured between the posts 11A, 11B of different door panels 10 during the mold injection processes, such that the users are not required to assemble the flexible hinge member 12 onto or between the posts 11A, 11B of the door panels 10. The flexible hinge member 12 thus will not be moved relative to the posts 11A, 11B of the door panels 10.

Accordingly, the door panel assembly in accordance with the present invention includes flexible hinge members for flexibly coupling door panels together, in which the flexible hinge members are solidly secured to the door panels and are not required to be assembled onto the door panels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door panel assembly comprising:

a first door panel including a first post and a second post each having an inner side portion, and each having a channel formed in said inner side portion thereof, at least one plate including two sides each having a catch provided thereon and slidably engaged in said channels of said posts, to secure said at least one plate between said first and said second posts of said first door panel, said at least one plate including a recess formed therein, said first and said second posts of said first door panel each including a pair of flanges extended inward of said channel thereof respectively and engaged with said catches of said at least one plate, to secure said at least one plate to said first and said second posts of said first door panel, said flanges of said first and said second posts of said first door panel each including an outer portion having a bar engaged therein and made of materials different from that of said first and said second posts of said first door panel, and each of said bars including an inclined outer surface formed therein, at least one board including two sides each having a catch provided thereon and slidably engaged in said channels of said posts, to secure said at least one board between said first and said second posts of said first door panel, at least one coupler coupled between said at least one board and said at least one plate, said at least one coupler being received in said recess of said at least one plate and including a groove formed therein, said at least one board including an edge engaged into said groove of said at least one coupler, and said at least one coupler including a pair of latches engaged with said at least one plate to maintain said at least one coupler at an edge of said at least one plate, said groove of said at least one coupler is formed between said latches.

a second door panel including a post, a first flexible hinge member secured between said post of said second door panel and said first post of said first door panel with mold injection processes, to prevent said first flexible hinge member from being moved relative to said post of said second door panel and said first post of said first door panel, a third door panel including a post, and a second flexible hinge member secured between said post of said third door panel and said second post of said first door panel with mold injection processes, to prevent said second flexible hinge member from being moved relative to said post of said third door panel and said second post of said first door panel.

2. The door panel assembly as claimed in claim 1, wherein said bars include a color different from that of said flanges of said first and said second posts of said first door panel.

* * * * *